US006968579B1

(12) United States Patent
Feinberg et al.

(10) Patent No.: US 6,968,579 B1
(45) Date of Patent: Nov. 29, 2005

(54) FLUSHING ACTIVATOR AND TOILET SEAT AND LID LIFTING AND CLOSING MECHANISM

(76) Inventors: Richard B. Feinberg, 3886 Belle Vista Dr. East, St. Pete Beach, FL (US) 33706; Stanley Hendzel, 371 Mehlenbacker Rd., Belleair Bluffs, FL (US) 33778

( * ) Notice: Subject to any disclaimer, the term of this patent is extended or adjusted under 35 U.S.C. 154(b) by 0 days.

(21) Appl. No.: 10/944,571

(22) Filed: Sep. 17, 2004

(51) Int. Cl.[7] ..... A47K 13/10
(52) U.S. Cl. ..... 4/246.1; 4/249
(58) Field of Search ..... 4/246.1–246.5, 4/249–250

(56) References Cited

U.S. PATENT DOCUMENTS

| | | | | |
|---|---|---|---|---|
| 4,150,446 | A | 4/1979 | Crocker | |
| 4,426,743 | A | 1/1984 | Seabrooke | |
| 4,470,161 | A | 9/1984 | Seabrooke | |
| 4,975,988 | A * | 12/1990 | Won | 4/246.3 |
| 5,323,496 | A | 6/1994 | Blair | |
| 5,504,947 | A * | 4/1996 | Robellop et al. | 4/246.1 |
| 5,659,902 | A | 8/1997 | Roberts, Jr. | |
| 6,233,751 | B1 | 5/2001 | Ford | |
| 6,263,517 | B1 | 7/2001 | Brooks | |
| 6,311,341 | B1 | 11/2001 | Zwezdaryk | |
| 6,438,764 | B1 | 8/2002 | Andersen | |
| 6,615,412 | B1 | 9/2003 | Hammond | |
| 6,651,262 | B1 | 11/2003 | Tinsley | |
| 6,907,621 | B2 * | 6/2005 | Stemen | 4/246.1 |
| 2002/0144337 | A1 * | 10/2002 | Moon | 4/246.1 |

* cited by examiner

*Primary Examiner*—Charles E. Phillips
(74) *Attorney, Agent, or Firm*—Larson & Larson, PA; Herbert W. Larson

(57) ABSTRACT

In the front of a standard toilet apparatus, left, middle, and right side pedals are mounted over a thin substrate between the toilet base and a floor. The pedals enclose a mechanical apparatus for tensioning cables connected to a junction box at a back end of the toilet. Cables from the junction box to the lid and seat lift and reset the lid and seat upon actuation of the left and right pedals. A cable from the junction box causes the toilet flushing mechanism to actuate upon depressing of the middle pedal.

15 Claims, 16 Drawing Sheets

LID DOWN, SEAT DOWN
ALL PEDALS UP

LID UP, SEAT DOWN
LEFT PEDAL DOWN, CENTER & RIGHT PEDAL UP

LID UP, SEAT UP
LEFT & RIGHT PEDAL DOWN, CENTER PEDAL UP

LID DOWN, SEAT DOWN, TOILET BEING FLUSH
LEFT & RIGHT PEDAL UP, CENTER PEDAL DOWN

LID DOWN, SEAT DOWN, TOILET FLUSHING
ALL PEDALS UP

FLUSHING ACTIVATOR AND TOILET SEAT AND LID LIFTING AND CLOSING MECHANISM

BACKGROUND OF THE INVENTION

1. Field of the Invention

The present invention relates to a toilet seat and lid opening and closing mechanism. More particularly, it relates to a combined toilet flushing activator and a toilet seat and lid lifting and resetting mechanism operable by a set of foot pedals positioned proximal to the base of the toilet. In effect, it is a hands-free, foot actuated, self-opening/closing toilet.

2. Description of the Prior Art

It is well known that toilets harbor bacteria and other microorganisms that can be harmful to human beings. These harmful agents can be transferred from the toilet to a person when a portion (i.e, the seat, lid or flush handle) of the toilet is touched by human hands.

Not all toilets have to be touched each time they are used. Men are able to use most urinals with motion sensor flushing which permits the man to avoid touching any part of the urinal. Men may have to touch the toilet when sitting down depending on the position of the seat at that time. On the other hand, women almost always have to touch the toilet each time they use one. Furthermore, most women prefer to close the lid of a toilet right after or right before flushing. Therefore, they are at a heightened risk of coming in contact with bacteria due to the increase of contact with the toilet structure as a whole. Also, women use the toilet with the seat down during every use (urination or defecation) and often have to lower the seat thereby coming in contact with any bacteria present on the toilet. Further, in many households, men simply do not place the seat back down after urinating. And, if they do not lift the seat up to urinate, they usually splash urine on the seat.

The result of a person using a toilet presents the possibility that harmful bacteria could be left thereupon by the previous user or users (this is amplified in public restrooms where a single toilet may be used multiple times before being cleaned with anti-bacteria cleaners). Some harmful bacteria are able to live a long life after they depart the infected host. For example, survival and environmental spread of many harmful bacteria agents, such as *Salmonella*, continues to exist even after a family member is no longer exhibiting symptoms of salmonellosis. *Salmonella* bacteria can persist in the biofilm material found underneath the recess of the toilet bowl. Other unwanted bacteria and sicknesses that are commonly found in toilets include *streptococcus*, staphylococci, *E. Coli*, shigellosis bacteria and hepatitis A.

Surprisingly, studies have shown that other areas of the bathroom can be infected on a worst scale than the toilet itself if these other areas are not immediately cleaned and maintained. This is a result of the so-called "aerosol effect" which spews small droplets of water from the toilet bowl into the air when the toilet is flushed prior to the lid being closed or where someone fails to close the lid after use. The bacteria ridden droplets deposit on items within the bathroom and the person/persons still present within the bathroom or those persons just entering. Flushing can cause the generation of a bacteria laden aerosol that could be inhaled. The aerosol effect can be greatly reduced if the lid is shut prior to flushing. Manually operated toilet seats and lids usually lead to undesirable results in that a majority of the time the person using the toilet forgets to shut the lid before flushing the waste, thereby initiating the undesired aerosol effect. To avoid this harmful effect and to further avoid, or at least minimize, touching the toilet, automatic flushing systems which lower and lift the lid where introduced. Such devices can be seen in U.S. Pat. Nos. 4,150,446, 4,426,743, 4,470,161, 5,323,496, 5,659,902, and 6,233,751 to name just a few. Some of these inventions also included mechanisms to lower and lift the seat. Most use complicated and cumbersome cabling and lift levers that are either retrofitted to an existing standard toilet or integrally made a part of an entire toilet system. Although these devices can lift the seats and lids of a toilet, they have proven to be ineffective due to their complicated nature. Improvements are clearly needed in toilet systems which include integral seat and lid lifting and lowering elements which are capable of being installed (retrofitted) to an existing standard toilet. The lifting and lowering elements should be non-intrusive, permit multiple conditions/configurations of lifting and lowering and be cost effective for consumers.

SUMMARY OF THE INVENTION

The present invention is a foot actuated flushing activator and toilet seat and lid lifting and closing mechanism that can be retrofitted or made as an integral part of a toilet. The mechanism permits the toilet seat and lid to be lifted and closed through the use of a set of foot pedals and without the need for hand operation. The flushing procedure also can be actuated by the foot pedals. This eliminates the need to hand-touch any portion of the toilet, including the seat, lid and flush handle, regardless of the position of the seat and lid at the time of approach and/or desired use. Multiple different configurations can be employed with the set of foot pedals to achieve the desired result of the end user (i.e., lift and lower seat and lid alone or together). The actuating mechanism also permits the manual operation of any of the above set forth features if desired or needed (in case of foot pedal actuating failure).

The entire opening and closing mechanism is provided on a thin substrate of an elastomeric substance which is mountable underneath a bottom surface of a standard toilet. A series of cables connect the set of foot pedals to the seat, lid and flush handle. A cable junction box is positioned behind the lower side of the toilet base and interconnects the four cables for the desired result.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
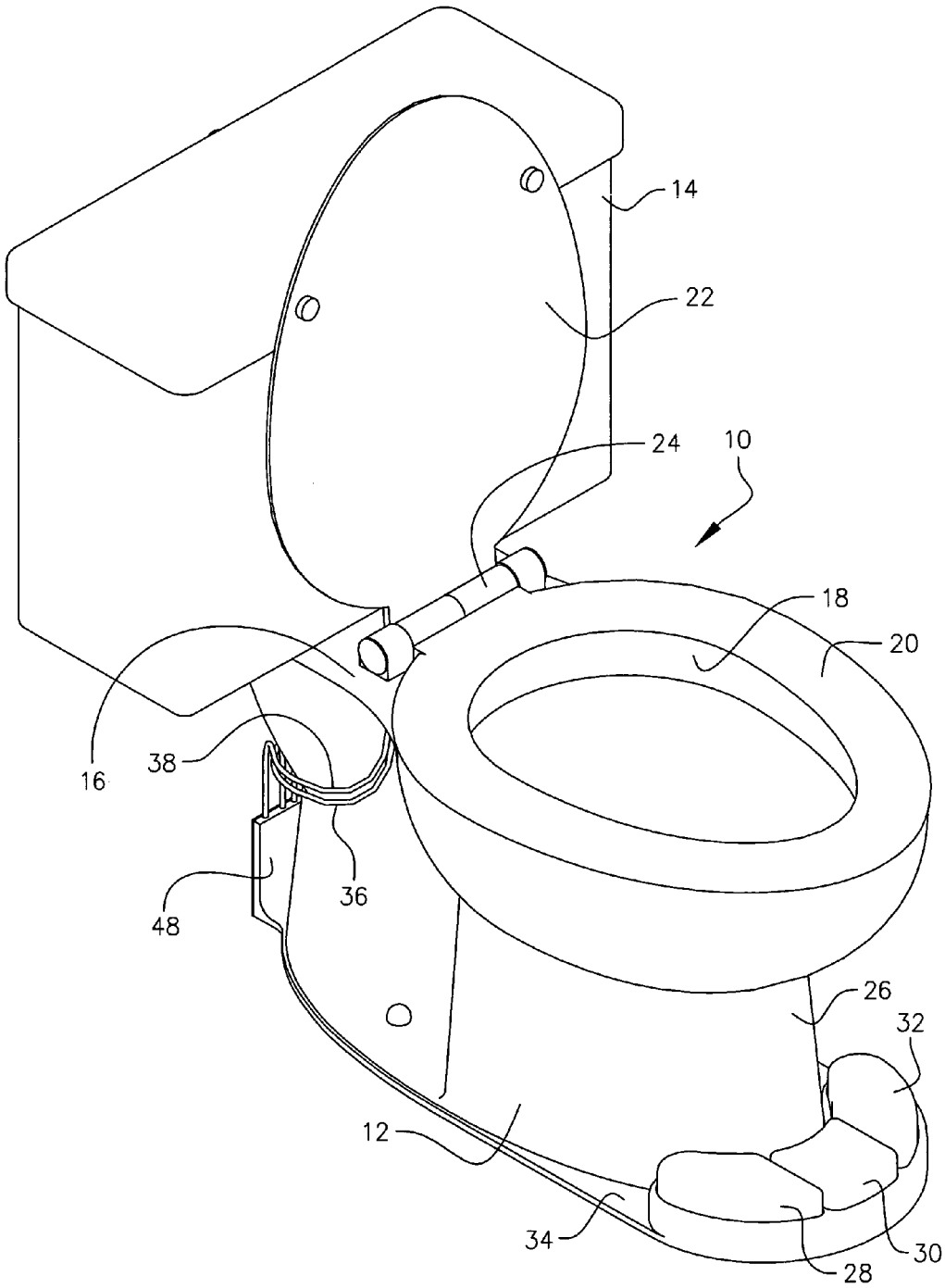
FIG. 1 is a front side perspective view of a standard toilet having a foot operated toilet seat and lid lifting and closing mechanism of the present invention fitted to a bottom surface thereof.

Throughout the following detailed description, the same reference numerals refer to the same elements in all figures.

Figure 2:
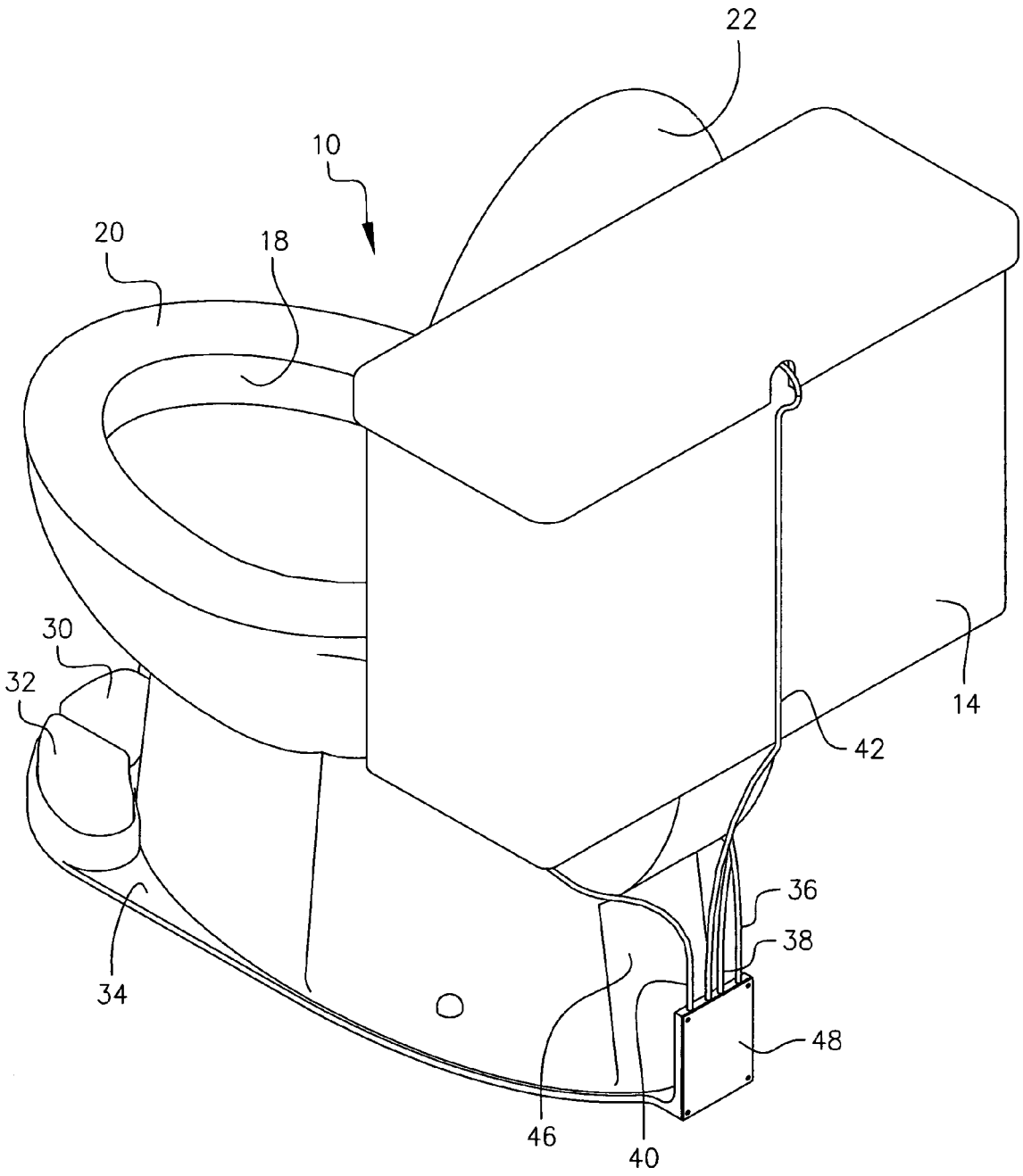
FIG. 2 is a back side perspective view of a standard toilet having the foot operated toilet seat and lid lifting and closing mechanism of the present invention fitted to the bottom surface thereof.
Figure 3:
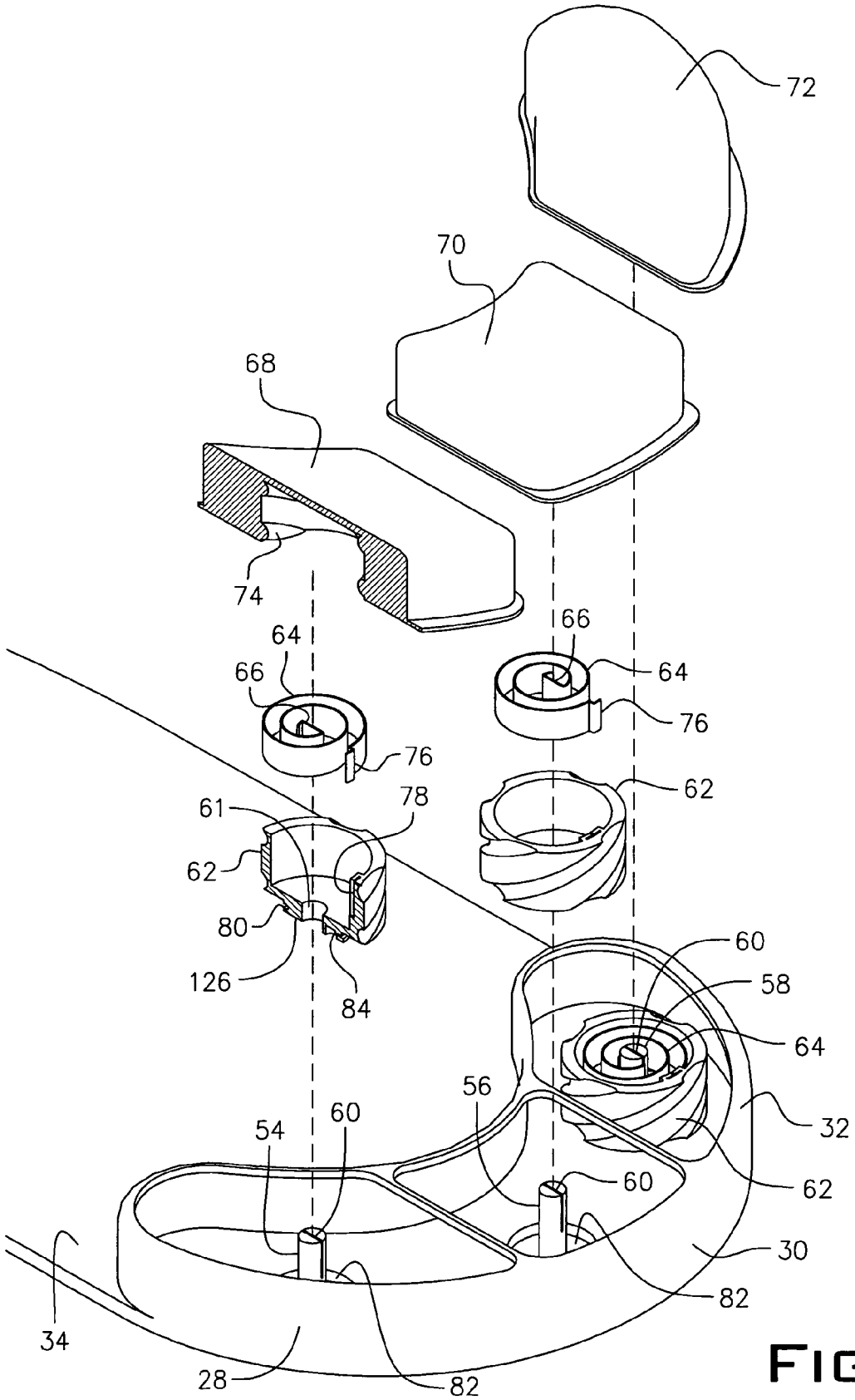
FIG. 3 is an exploded view of the foot pedal mechanism of the toilet seat and lid lifting and closing mechanism of the present invention.

Referring to FIGS. 1 and 2, a toilet 10 is shown having a base 12 and a tank 14. The base 12 has a top surface 16 and a bowl 18 on which a seat 20 rests. A lid 22 and the seat 20 are attached to the base top surface by a hinge 24. At a lower front 26 of the base 12 are a group of three pedals 28, 30 and 32.

Figure 14:
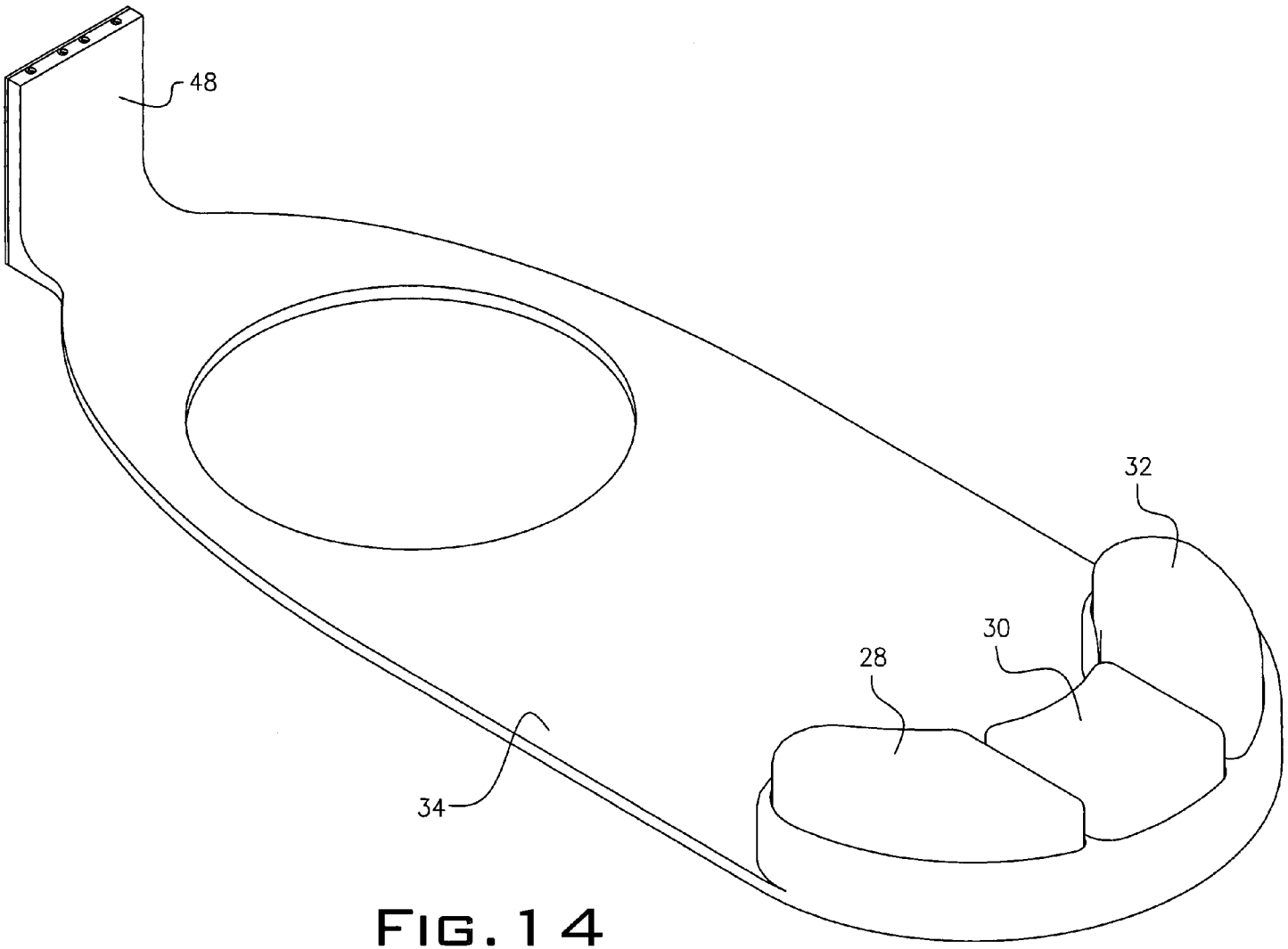
FIG. 14 is a top perspective view of the foot pedals and connecting pad to the cable junction box.

A thin substrate 34 is mounted between the bottom of base 12 and the floor. Cables 35, 37 and 39 connect the pedals 28, 30 and 32, respectively, to block connectors 86, 90 and 98. The substrate 34 receives the cables 35, 37, and 39 as seen in FIG. 14. A cable junction box 48 positioned at the back 46 of base 12 directs the cables to their corresponding block connector. A back plate 50 encloses the junction box 48. Four screws 52 retain plate 50 in place.

Figure 13:
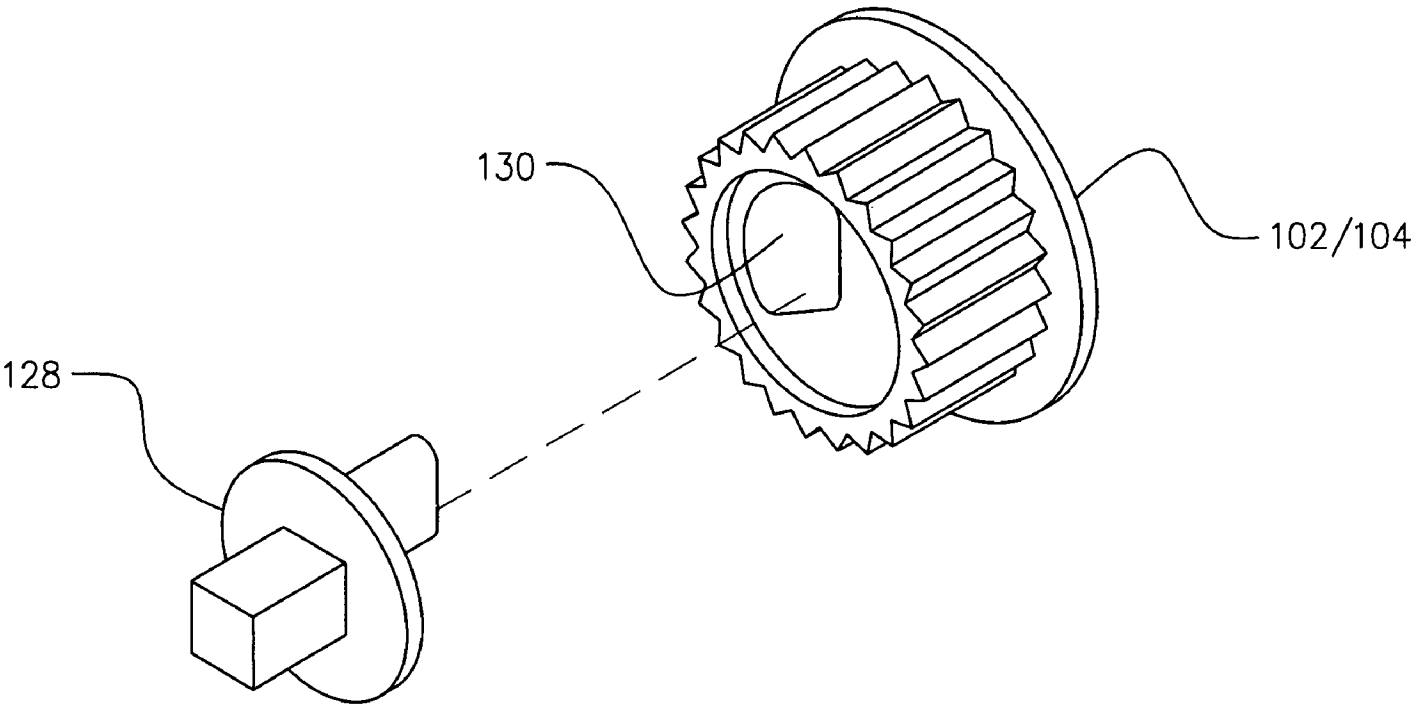
FIG. 13 is a perspective view of a cap containing a gel mixture.

Referring to FIG. 13, pedals 28, 30 and 32, are integral with substrate 34. Each pedal has an upright pin 54, 56 and 58, respectively. An identical slot 60 is located within a top portion of each pin 54, 56 and 58. A female threaded cylinder 62 fits around pins 60 at center hole 61, and a spring 64 sits within cylinder 62 around the pin. An end 66 of spring 64 engages slot 60 in each pin. Covers 68, 70 and 72 seat over pins 54, 56 and 58, respectively. An inside lower portion of each cover has male threads 74 that engage the external female threads on corresponding cylinder 62. An end 76 of spring 64 is seated in slot 78 of cylinder 62. A lip 80 of cylinder 62 fits within depression 82 around pin 60 at cable attachment point 84.

When any cover 68, 70 or 72 is depressed, the male threads 74 engage the external female threads of cylinder 62 and cause the cylinder to rotate about pin 60 in a counter clockwise direction. As the cylinder 62 turns, the cable attached at attachment 84 is pulled tightly.

Figure 4:
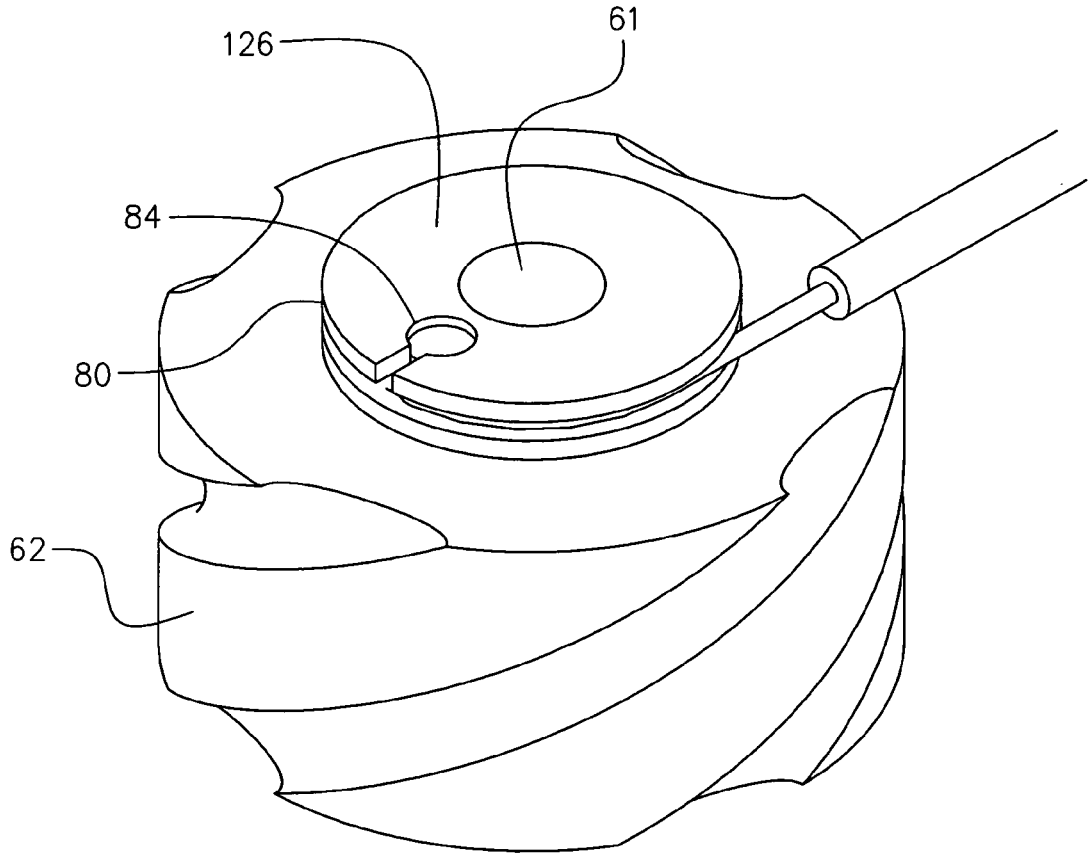
FIG. 4 is a bottom plan view of a cylinder containing a cable attachment site.
Figure 5:
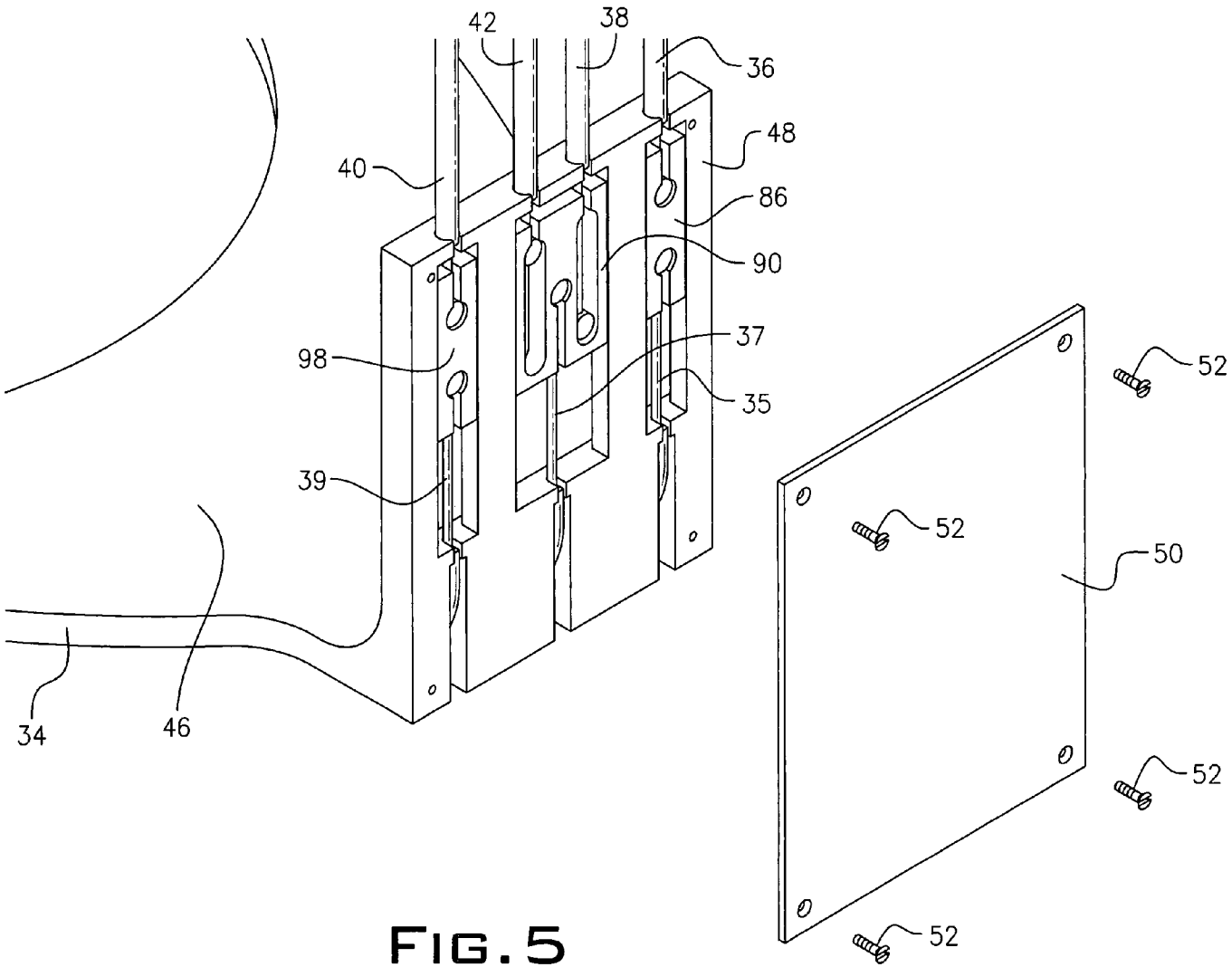
FIG. 5 is a perspective view of a cable junction box of the foot operated toilet seat and lid lifting and closing mechanism of the present invention.
Figure 10:
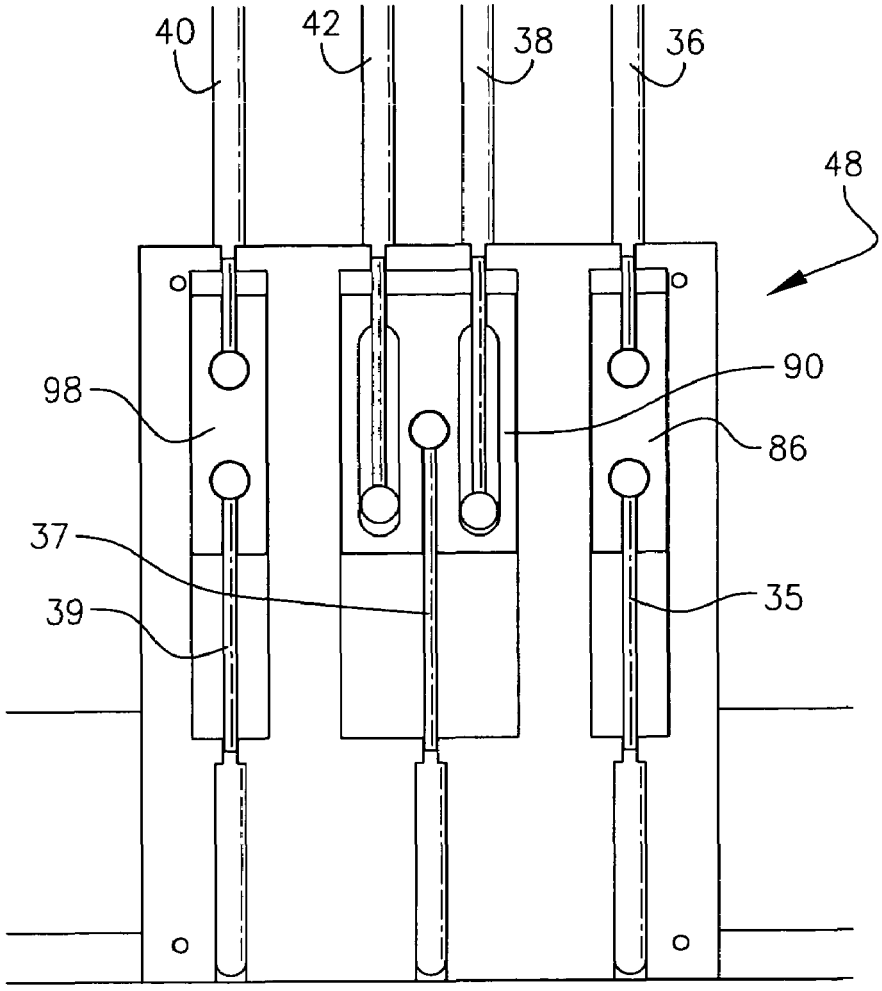
FIG. 10 is a front elevational view (Position 5) of the cable junction box.
Figure 15:
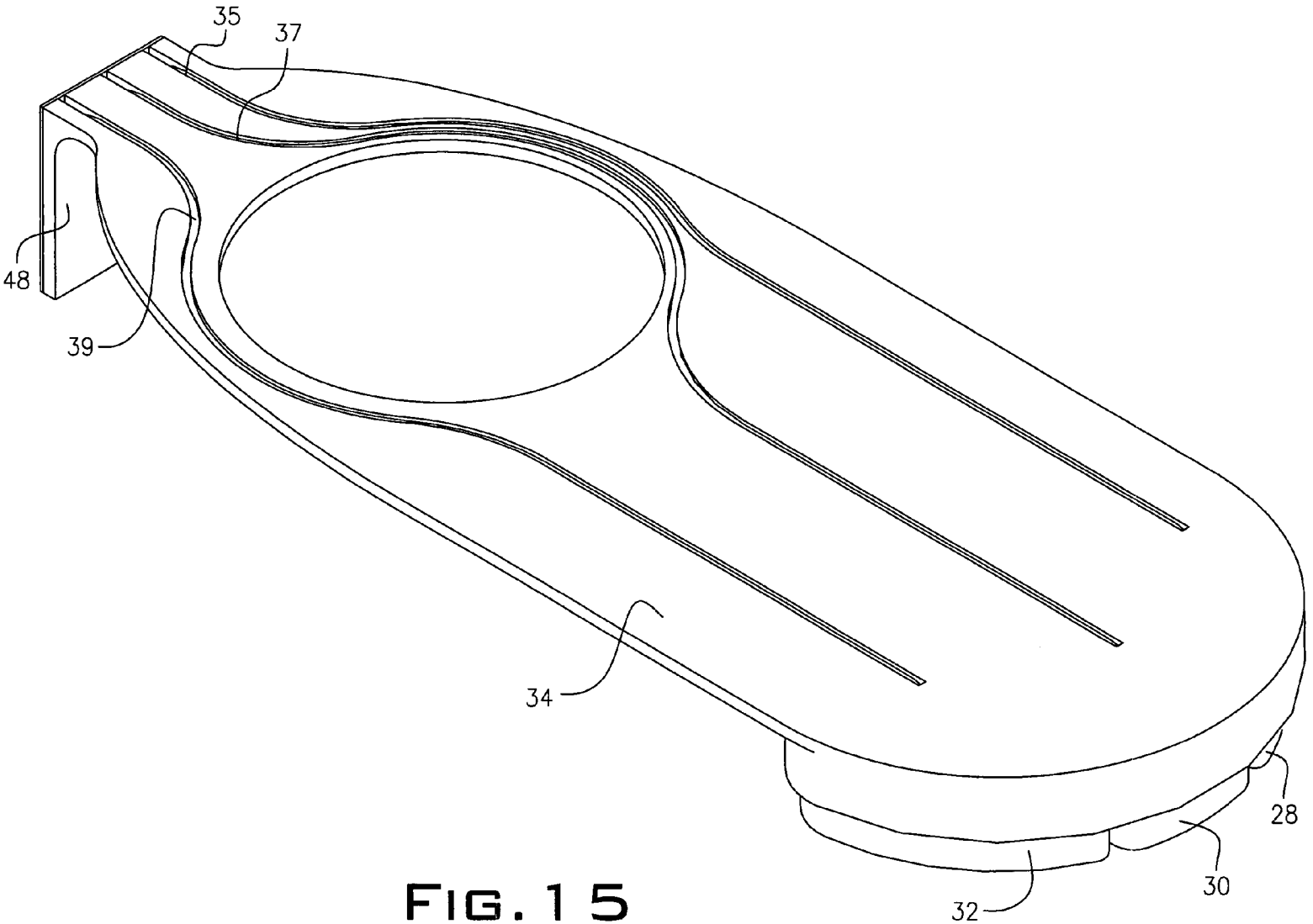
FIG. 15 is a bottom perspective view of the foot pedals and connection pad containing cables leading to the cable junction box.
Figure 16:
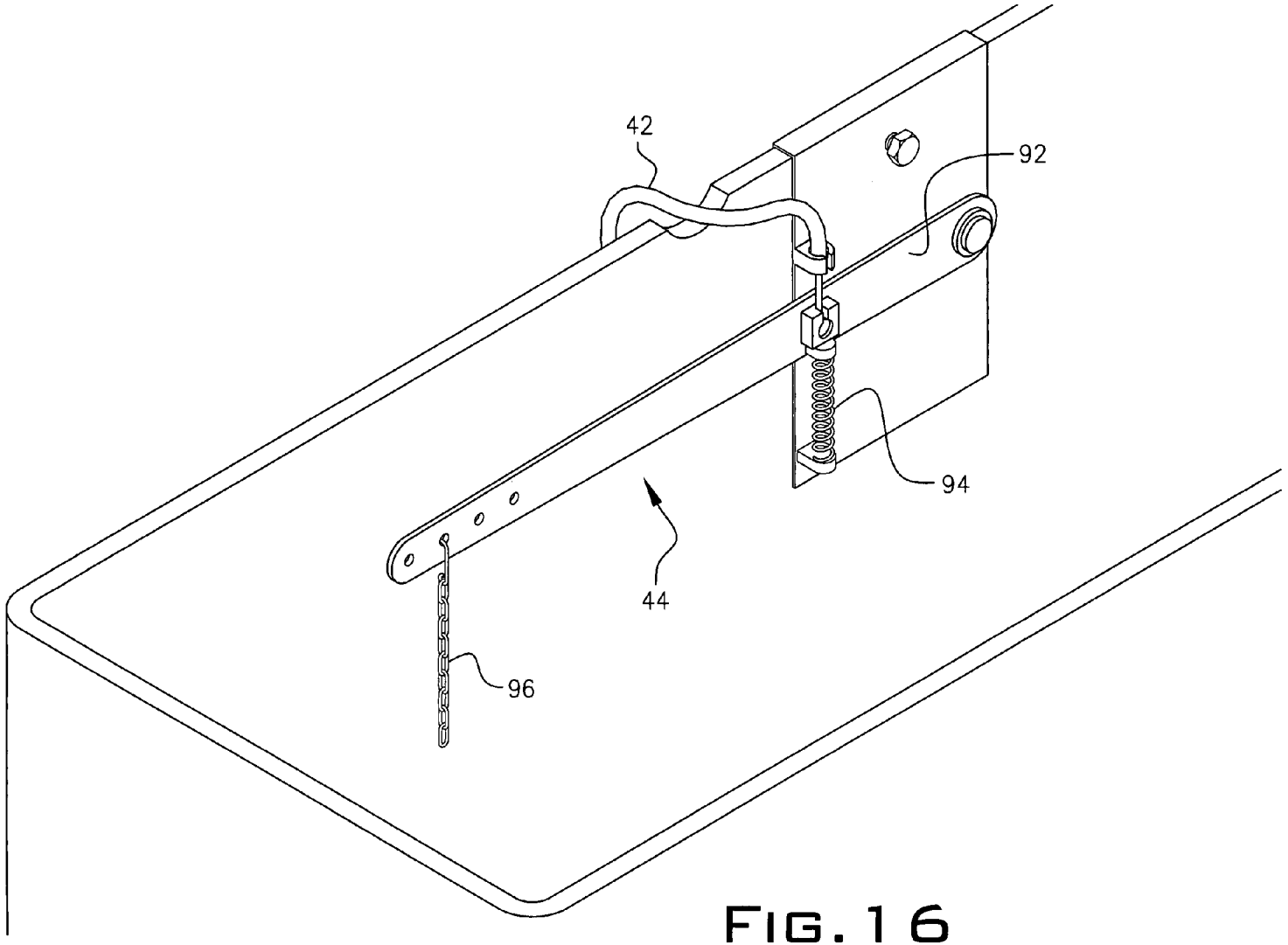
FIG. 16 is a perspective view of an inner area of a tank of a toilet illustrating a distal end of a cable employed with the foot operated toilet seat and lid lifting and closing mechanism of the present invention for flushing the toilet.

As seen in FIGS. 4 and 14, cable 35, enclosed in a jacket, connects to a block connector 86 within junction box 48. Cable 36, enclosed in a jacket, connects to the block connector 86 at a first end and at a second end around a groove 88 in hinge 24, as seen in FIG. 10. Cable 37, enclosed in a jacket, connects to a block connector 90 within junction box 48. Cable 38, enclosed in a jacket, connects to the block connector 90 at a first end and at a second end to the groove 88 in hinge 24. Cable 42, enclosed in a jacket, connects to block connector 90 at a first end and at a second end to a toilet flush arm 92, as seen in FIG. 15. As cable 42 is pulled tight, arm 92 raises against the tension of spring 94 to lift the toilet flushing chain 96 to empty the tank of its water. As tension is removed on cable 42, the spring 94 pulls arm 92 downwardly and causes the water outlet cover (not shown) in the tank to reseat and permit filling of the tank.

Cable 39, enclosed in a jacket, connects to block connector 98 within junction box 48. Cable 40, enclosed in a jacket, connects to the block connector 98 at a first end and at a second end to a notch 100 in the hinge mechanism 24, as seen in FIG. 10. Set screw 120 holds cable 40 in notch 100.

Figure 11:
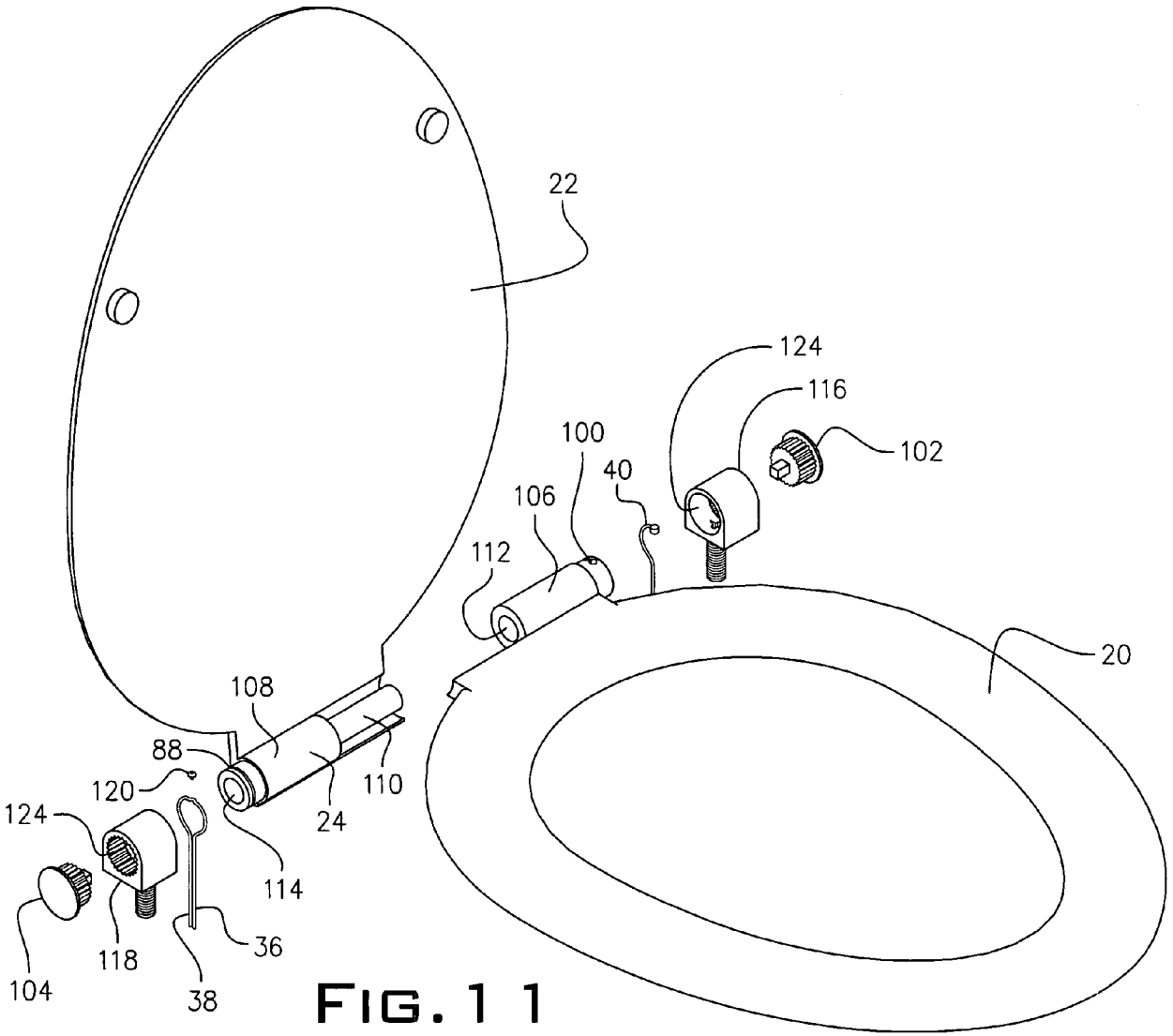
FIG. 11 is a top perspective view of the hinge mechanism for the lifting and closing of the seat and lid prior to being fitted to a toilet.
Figure 12:
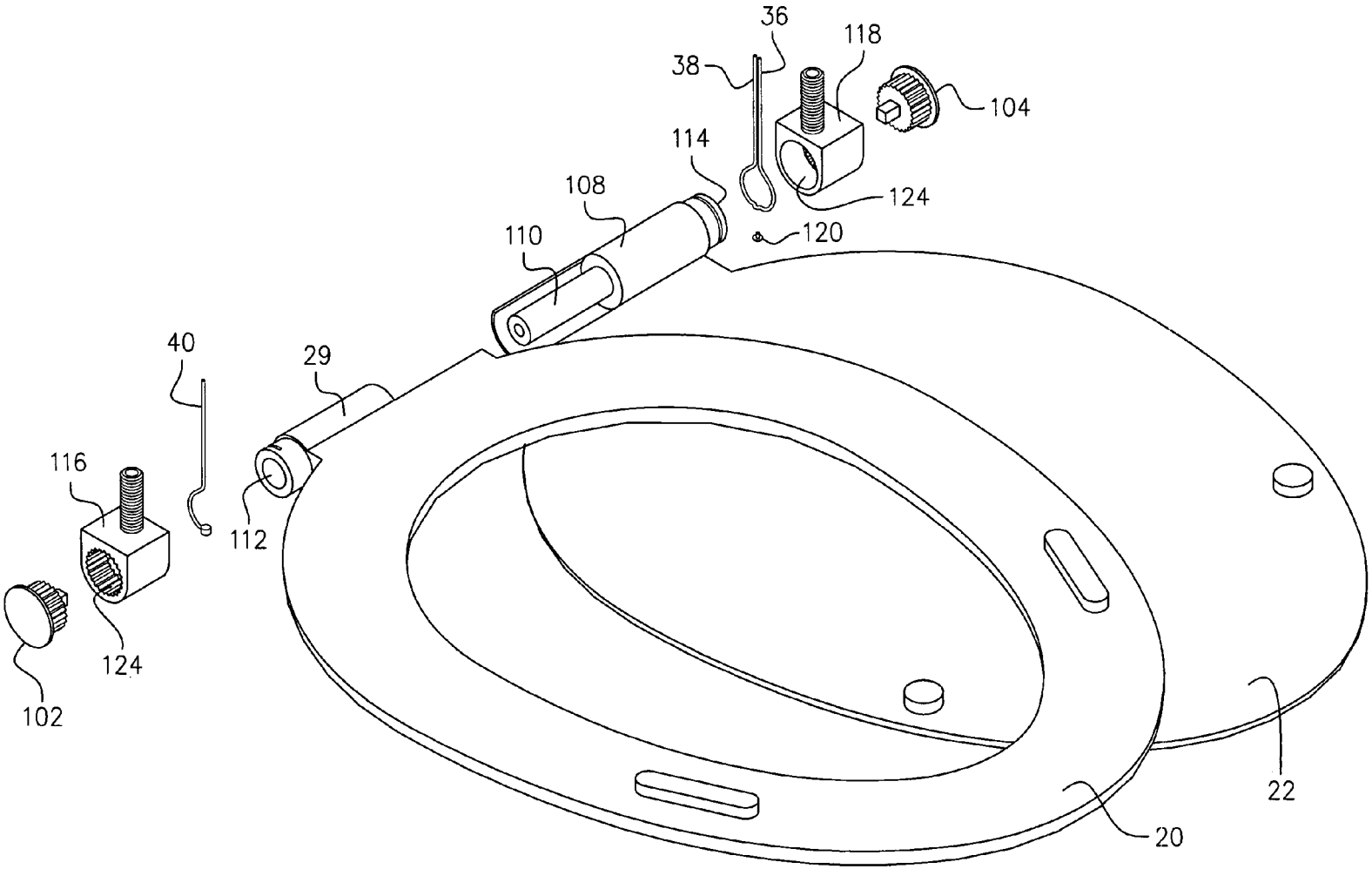
FIG. 12 is a bottom perspective view of the hinge mechanism for the lifting and closing of the seat and lid prior to being fitted to a toilet.

Referring to FIGS. 10 and 11, the hinge mechanism 24 controls the raising and lowering of lid 22 and seat 20. The hinge mechanism 24 has an outer cylindrical sleeve 106 integral with a back end of toilet seat 20 and an outer cylindrical sleeve 108 integral with a back end of lid 22. A tube 110 fits within opening 112 in sleeve 106 and within opening 114 in sleeve 108. As tension is put on cables 40 and 36 the seat 20 and lid 22 rise. As tension is put on cable 38 the lid 22 and seat 20 fall. Seating housings 116 and 118 attach the lid and seat to the bowl 18 with a thread nut (not shown). Gel containing caps 102 and 104, respectively, fit into splined grooves 124 within the seating housings 116 and 118, the gel on caps 102 and 104 causing the seat and lid to fall softly. Caps 102 and 104 have an opening 130 for inserting of the gel and lid 128 closes the opening.

Figure 6:
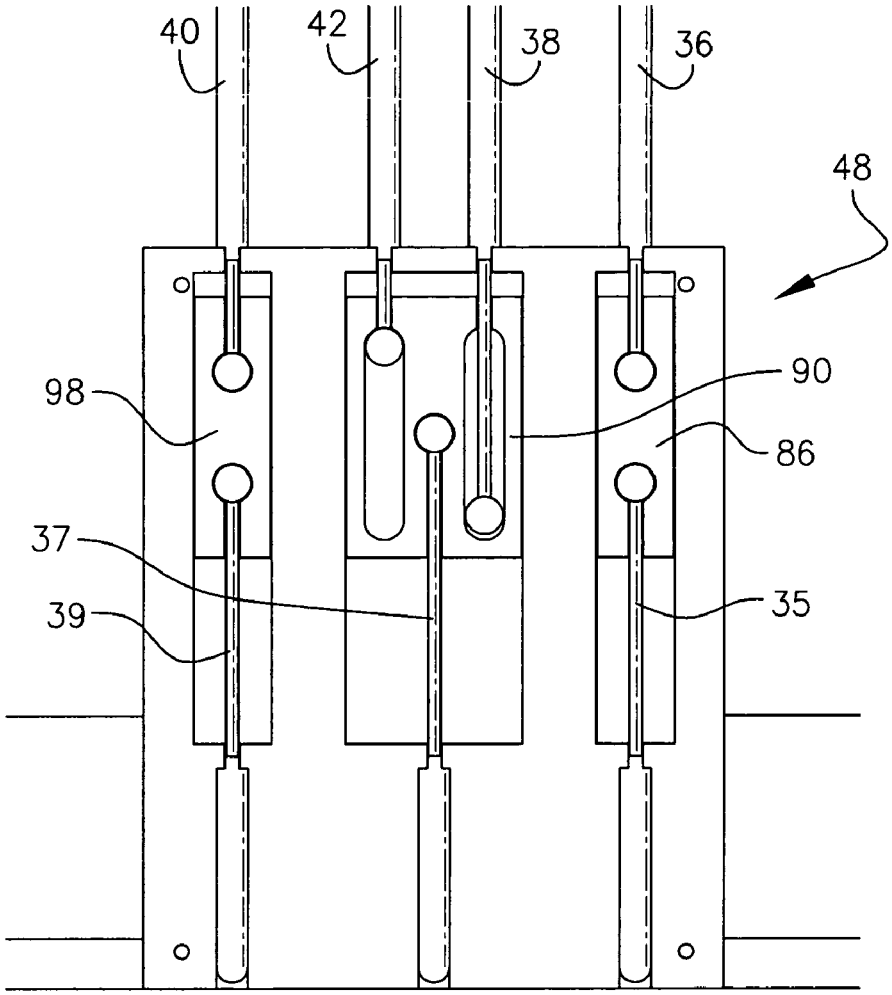
FIG. 6 is a front elevational view (Position 1) of the cable junction box.
Figure 7:
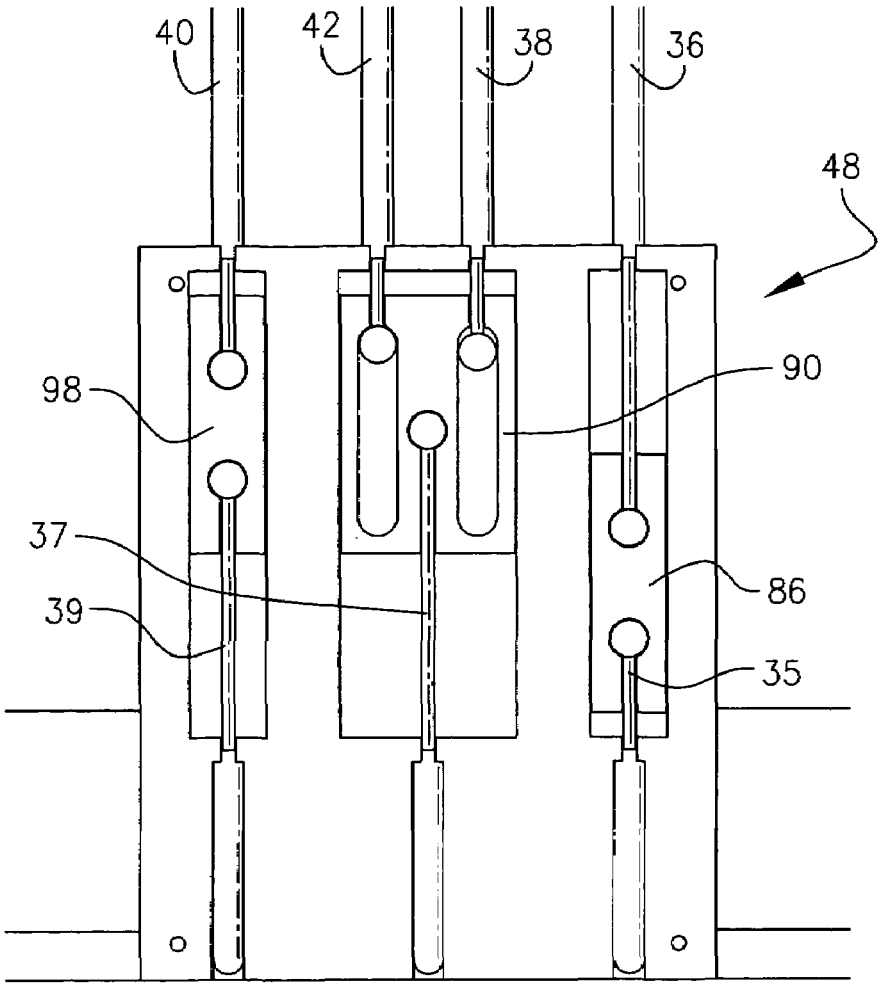
FIG. 7 is a front elevational view (Position 2) of the cable junction box.
Figure 8:
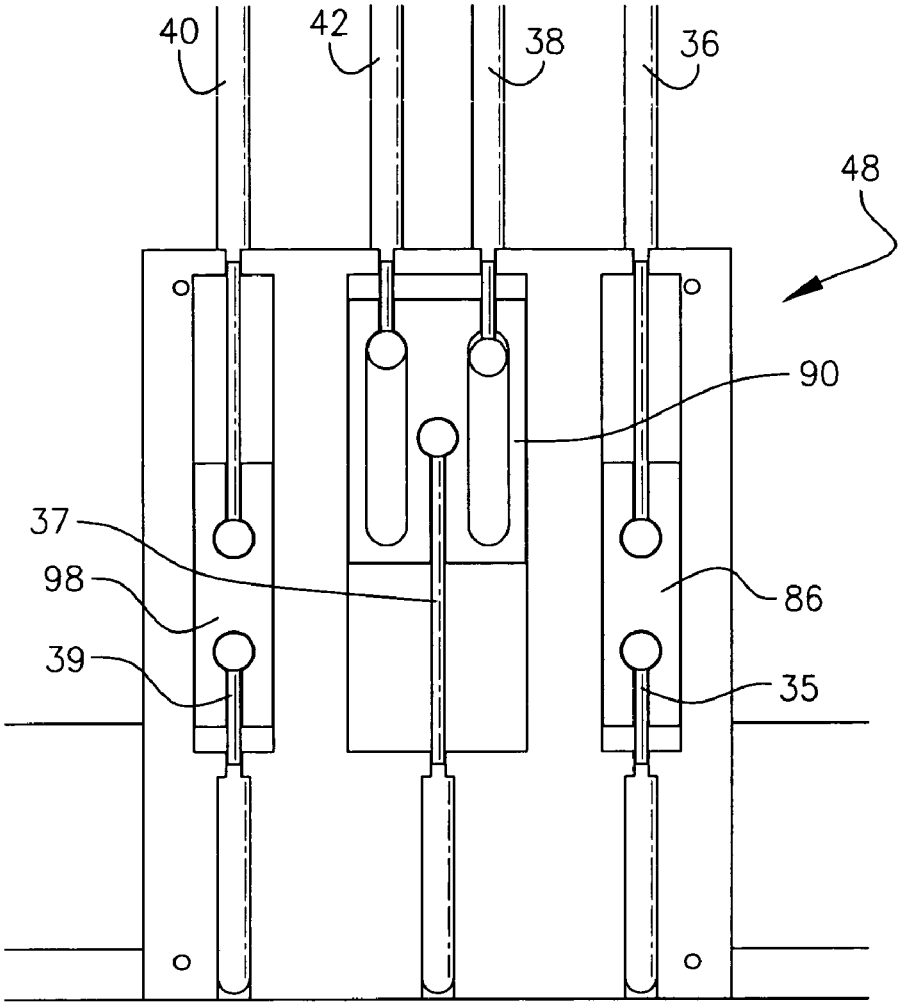
FIG. 8 is a front elevational view (Position 3) of the cable junction box.
Figure 9:
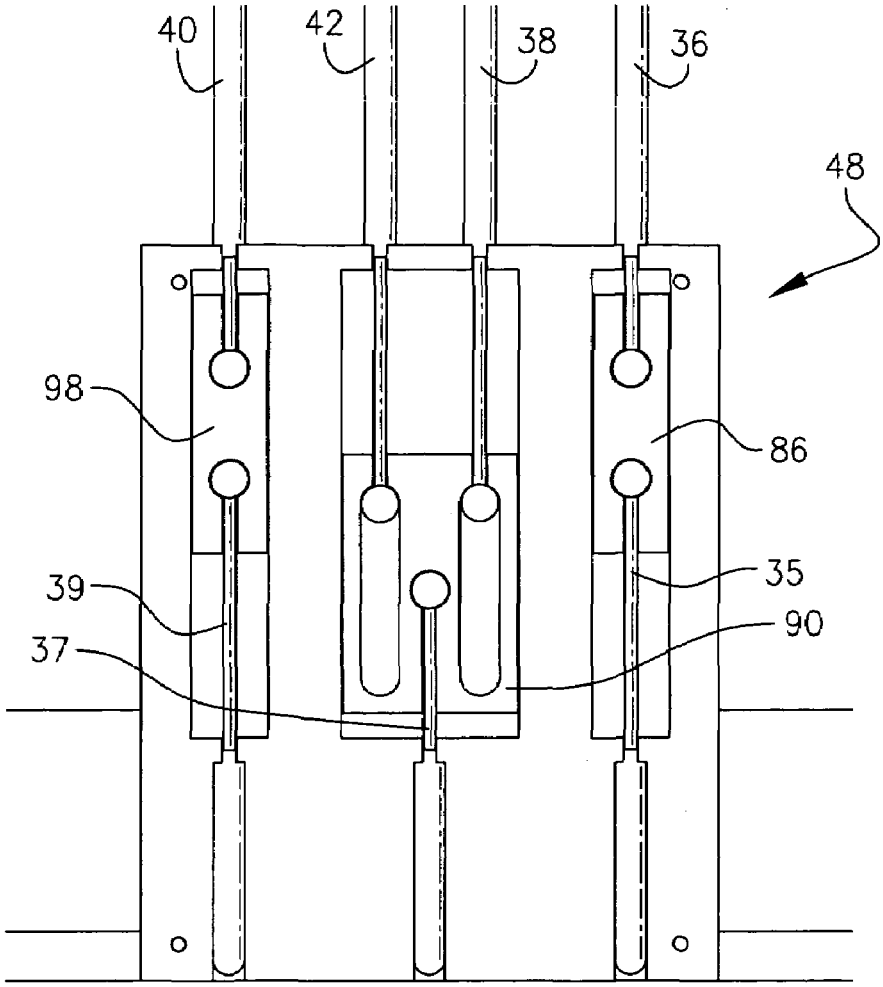
FIG. 9 is a front elevational view (Position 4) of the cable junction box.

Referring to FIGS. 6–10, no pressure on pedals 28, 30, and 32 gives the position in the junction box 48 of three cables in block connectors 86, 90 and 98, as shown in FIG. 6. With the left pedal 28 depressed, cable 35 pulls connector block 86 downwardly to cause tension on cable 36 which acts to lift lid 22 upwardly, as shown in FIG. 7. With both the left 28 and right 32 pedals depressed, cables 35 and 40 are under tension to lift both the lid and seat upwardly, as seen in FIG. 8. With only the center pedal 30 depressed, the lid 22 and seat 20 are down and the toilet is being flushed, as seen in FIG. 9. With all pedals 28, 30, and 32 up, the toilet flushing is completed and the lid 22 and seat 20 are down, as shown in FIG. 10.

Other equivalent elements can be substituted for the elements disclosed herein to produce the same results in the same way.

Having thus described the invention what is claimed and desired to be secured by Letters Patent is:

1. A combined toilet flushing activator and a seat and lid lifter and resetting apparatus mountable to a toilet, the toilet having a base and a tank, the base having a top surface surrounding an interior bowl, a seat and lid hingedly coupled on a back portion of the base top surface, the tank containing a flushing apparatus, the toilet flushing activator and the seat and lid lifting and resetting apparatus comprising:

a) a left, a middle, and a right side pedal mounted at a front of the toilet base over a thin substrate, the substrate surface area primarily located between the base and a floor;

b) the left side, middle and right side pedals each having a top and bottom housing, the bottom housing having an upwardly directed pin within a depression in a floor of the bottom housing, a cylinder having a hole for receipt of the upwardly directed pin and a coil spring mounted within the cylinder around the pin, the pin having a slot in an upper portion for receipt of a first end of the spring and a slot in a side wall of the cylinder for receipt of a second end of the spring, the cylinder having female threads on an outer circumference for engaging with male threads on an inside surface of the top housing, a lower surface of the cylinder having a cable attachment site through the depression in the bottom housing floor;

c) a cable first end connected at each cable attachment site mounted within the substrate so as to connect the first end of the cable to the cylinder cable attachment and a second end to a movable connector block within a junction box mounted behind the bowl, additional cables connecting the junction box block to a hinge mechanism for the lid and seat and another to the toilet flushing apparatus so that upon depressing of the pedals the lid and seat, and toilet flushing apparatus are activated to initially lift the lid, and thereafter, lift the seat and flush the toilet.

2. The combined toilet flushing activator and seat and lid lifting and resetting apparatus according to claim 1, wherein the left side pedal connects a first cable to the connector block within the junction box attached to a second cable adapted to lift the lid upwardly.

3. The combined toilet flushing activator and seat and lid lifting resetting apparatus according to claim 1, wherein the left and right side pedals connect cables to corresponding left and right side connector blocks within the junction box attached to cables adapted to lift the lid and seat upwardly.

4. The combined toilet flushing activator and seat and lid lifting and resetting apparatus according to claim 1, wherein the middle pedal connects a cable to the corresponding middle connector block within the junction box attached to a cable adapted to flush the toilet.

5. The combined toilet flushing activator and seat and lid lifting and resetting apparatus according to claim 4, wherein a cable from the connector block connects to a flushing arm in the tank.

6. The combined toilet flushing activator and seat and lid lifting and resetting apparatus according to claim 5, wherein the flushing arm is maintained in a lowered position by a spring member and is raised when the cable from the middle connector block is under tension.

7. The combined toilet flushing activator and seat and lid lifting and resetting apparatus according to claim 1, wherein there is a single cable entering the left, middle, and right connector block, and a single cable leaving the left and right connector block, and two cables leaving the middle connector block.

8. A toilet having a base and a tank, the base having a top surface surrounding an interior bowl, a seat and lid hingedly coupled on a back portion of the base top surface, the tank containing a flushing apparatus, the improvement comprising:

a) a left, a middle, and a right side pedal mounted at a front portion of the toilet base over a thin substrate, the substrate having a majority of its surface area between the base and a floor;

b) the pedals each having a top and a bottom housing, bottom housing having an upwardly directed pin within a depression in a floor of the bottom housing, a cylinder having an opening for receipt of the upwardly directed pin and a coil spring mounted within the cylinder around the pin, the pin having a slot in an upper portion for receipt of a first end of the spring and a slot in a side wall of the cylinder for receipt of a second end of the spring, the cylinder having female threads on an outer circumference for engaging with male threads on an inside surface of the top housing, a lower surface of the cylinder having a cable attachment site through the depression in the bottom housing floor;

c) a first end of a cable connected at each cable attachment site, the cables mounted within the substrate so as to connect at a second end of each cable to a corresponding movable connector block within a junction box mounted behind the bowl, additional cables connecting each connector block to a hinge mechanism for the lid and seat and toilet flushing apparatus so that upon depression of the pedals the lid, seat, and flushing apparatus are activated to initially lift the lid and, thereafter, lift the seat and flush the toilet.

9. The improvement in a toilet according to claim 8, wherein a first cable connects the left side pedal to a left side connector block, a second cable connects the middle pedal to a middle connector block, and a third cable connects the right side pedal to a right side connector block.

10. The improvement in a toilet according to claim 9, wherein the left side connector block connects a fourth cable to a groove in a hinge mechanism.

11. The improvement in a toilet according to claim 10, wherein the middle connector block connects a fifth cable to the groove in the hinge mechanism and a sixth cable to an arm of the flushing apparatus.

12. The improvement in a toilet according to claim 9, wherein the right side connector block connects a seventh cable to a notch in the hinge mechanism.

13. The improvement in a toilet according to claim 11, wherein the sixth cable lifts the arm of the flushing apparatus over the force of a spring member when the middle pedal is depressed.

14. The improvement in a toilet according to claim 8, wherein the cable attachment site in the lower surface of the cylinder is a grooved ring for retaining the first end of the cable.

15. The improvement in a toilet according to claim 8, wherein the cylinder turns in a counter-clockwise direction when a pedal is depressed.

* * * * *